US005587024A

United States Patent [19]

Nakayama et al.

[11] Patent Number: 5,587,024

[45] Date of Patent: Dec. 24, 1996

[54] SOLID RESIN-COATED MAGNET POWDER AND A METHOD FOR PRODUCING AN ANISOTROPIC BONDED MAGNET THEREFROM

[75] Inventors: Ryoji Nakayama; Takuo Takeshita; Muneaki Watanabe, all of Saitama-ken, Japan

[73] Assignee: Mitsubishi Materials Corporation, Tokyo, Japan

[21] Appl. No.: 423,272

[22] Filed: Apr. 17, 1995

Related U.S. Application Data

[62] Division of Ser. No. 71,565, Jun. 1, 1993, abandoned.

[30] Foreign Application Priority Data

Jun. 1, 1992 [JP] Japan ..... 4-165349

[51] Int. Cl.[6] ..... H01F 1/03

[52] U.S. Cl. ..... 148/101; 148/105

[58] Field of Search ..... 148/105, 101, 148/103, 104

[56] References Cited

U.S. PATENT DOCUMENTS

| | | | |
|---|---|---|---|
| 4,983,232 | 1/1991 | Endoh et al. | 148/302 |
| 5,110,374 | 5/1992 | Takeshita et al. | 148/101 |
| 5,486,239 | 1/1996 | Nakayama et al. | 148/101 |

*Primary Examiner*—Sikyin Ip
*Attorney, Agent, or Firm*—Morrison Law Firm

[57] ABSTRACT

A solid resin-coated composite magnet powder for producing an improved anisotropic bonded magnet contains individual anisotropic magnet powder particles each having a surface coated with a solid resin layer thereon. A method is disclosed for producing a solid resin-coated magnet powder, including the steps of kneading an anisotropic magnet powder with a solid resin under a reduced pressure, granulating the resultant mixture to produce a solid resin-coated composite magnet powder, and milling the composite magnet powder produced to separate the solid resin-coated composite magnet powder into individual anisotropic magnet powder particles coated with the solid resin.

4 Claims, 2 Drawing Sheets

PRIOR
ART

SOLID RESIN-COATED MAGNET POWDER AND A METHOD FOR PRODUCING AN ANISOTROPIC BONDED MAGNET THEREFROM

This is a divisional application of co-pending application Ser. No. 08/071,565, filed on Jun. 1, 1993, now abandoned.

BACKGROUND OF THE INVENTION

The present invention relates to a solid resin-coated magnet powder for producing an improved anisotropic bonded magnet, and a method of producing the magnet.

An anisotropic bonded magnet as disclosed, for example, in Japanese Patent Laid-Open No. 1-281707, is conventionally formed by kneading an anisotropic magnet powder with a solid resin such as a solid epoxy resin, a polyester resin, a phenolic resin or the like, granulating the resultant mixture to form solid resin coated particles, press-molding the solid resin-coated magnet powder in a magnetic field to form a molded product, and curing the solid resin by heating the molded product. The use of a solid resin-coated magnet powder is considered be superior to one which is liquid coated because it has better fluidity, and can thus be cast to form a thinner product.

Referring to FIG. 3, an anisotropic bonded magnet produced by the above conventional method mainly consists of a solid resin-coated composite magnet powder 5 containing a plurality of anisotropic magnet powder particles 1 coated with a solid resin 2. Even if each of the individual anisotropic magnet powder particles 1 has a high degree of anisotropy, the plurality of the anisotropic magnet powder particles 1 collectively exhibit random orientation directions 4. Thus, the solid resin-coated composite magnet powder 5 has insufficient anisotropy as a whole, and cannot be oriented to exhibit sufficient anisotropy when molded in a magnetic field to produce a magnet. As a result, the anisotropic bonded magnet produced by the prior-art method has generally poor magnetic characteristics. There is also the problem that a molded product using the conventional solid resin-coated composite magnet powder 5 has a lower density than that of a molded product of liquid resin-coated magnet powder produced using the same molding pressure.

OBJECTS AND SUMMARY OF THE INVENTION

It is an object of the present invention to provide a solid resin-coated magnet powder for producing an improved anisotropic bonded magnet and a method of producing the anisotropic magnet which overcome the drawbacks of the prior art.

It is a further object of the invention to provide a solid resin-coated composite magnet powder for producing an anisotropic bonded magnet, comprising an anisotropic magnet powder and a solid resin formed on the surface of the magnet powder.

It is a still further object of the invention to provide a method for producing a solid resin-coated magnet powder for producing a magnet, comprising kneading an anisotropic magnet powder with a solid resin in an atmosphere under reduced pressure, granulating the resultant mixture to form solid resin-coated composite magnet powder, and then cracking the composite magnet powder to separate it into individual anisotropic magnet powder particles contained within the solid resin-coated composite magnet powder.

Briefly stated, the present invention provides a solid resin-coated composite magnet powder for producing an improved anisotropic bonded magnet containing individual anisotropic magnet powder particles each having a surface coated with a solid resin layer thereon. A method is disclosed for producing a solid resin-coated magnet powder, including the steps of kneading an anisotropic magnet powder with a solid resin under a reduced pressure, granulating the resultant mixture to produce a solid resin-coated composite magnet powder, and milling the composite magnet powder produced to separate the solid resin-coated composite magnet powder into individual anisotropic magnet powder particles coated with the solid resin.

According to an embodiment of the invention, there is provided a solid resin-coated magnet powder comprising: discrete anisotropic magnet powder particles; and, each of the discrete anisotropic magnet powder particles having a surface coated with a solid resin.

According to a feature of the invention, there is provided a solid resin-coated magnet powder, comprising: at least 30 volume percent of the magnet powder being discrete anisotropic magnet powder particles; and, each of the discrete anisotropic magnet powder particles having a surface coated with a solid resin.

According to a further feature of the invention, there is provided a method of making a solid resin-coated magnet powder comprising: kneading an anisotropic magnet powder with a solid resin in a reduced pressure atmosphere to produce a mixture of anisotropic magnet powder and solid resin, granulating the mixture to form a solid resin-coated composite magnet powder and, cracking the solid resin-coated composite magnet powder to separate it into discrete anisotropic magnet powder particles coated with the solid resin.

According to a further feature of the invention, there is provided a method for making a solid resin-coated magnet powder comprising: forming an alloy ingot, heating the alloy ingot in a hydrogen atmosphere, continuing the heating to promote phase transformation of the alloy ingot, maintaining the alloy ingot in a vacuum at an elevated temperature to further promote phase transformation, grinding the ingot to produce an anisotropic powder, dissolving a plastic resin in a solvent to produce a solution, mixing the anisotropic powder with the solution, kneading the anisotropic powder in the solution in a vacuum until the solvent is substantially completely volatilized, granulating the product of the kneading step to produce a composite powder; and, ball milling the composite powder to produce a resulting product containing a substantial fraction consisting of individual magnet powder particles coated with the plastic resin.

According to a still further feature of the invention, there is provided a process for forming resin-coated magnet particle powder comprising: producing magnet powder particles, the magnet powder particles each having a magnetic orientation direction, mixing the magnet powder particles with a resin dissolved in a solvent, evaporating the solvent to produce a composite powder containing the magnet powder particles in solid resin, granulating the composite powder to produce a granulated composite powder; and, milling the granulated composite powder to produce a predetermined fraction of discrete magnet powder particles each coated with the solid resin. The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
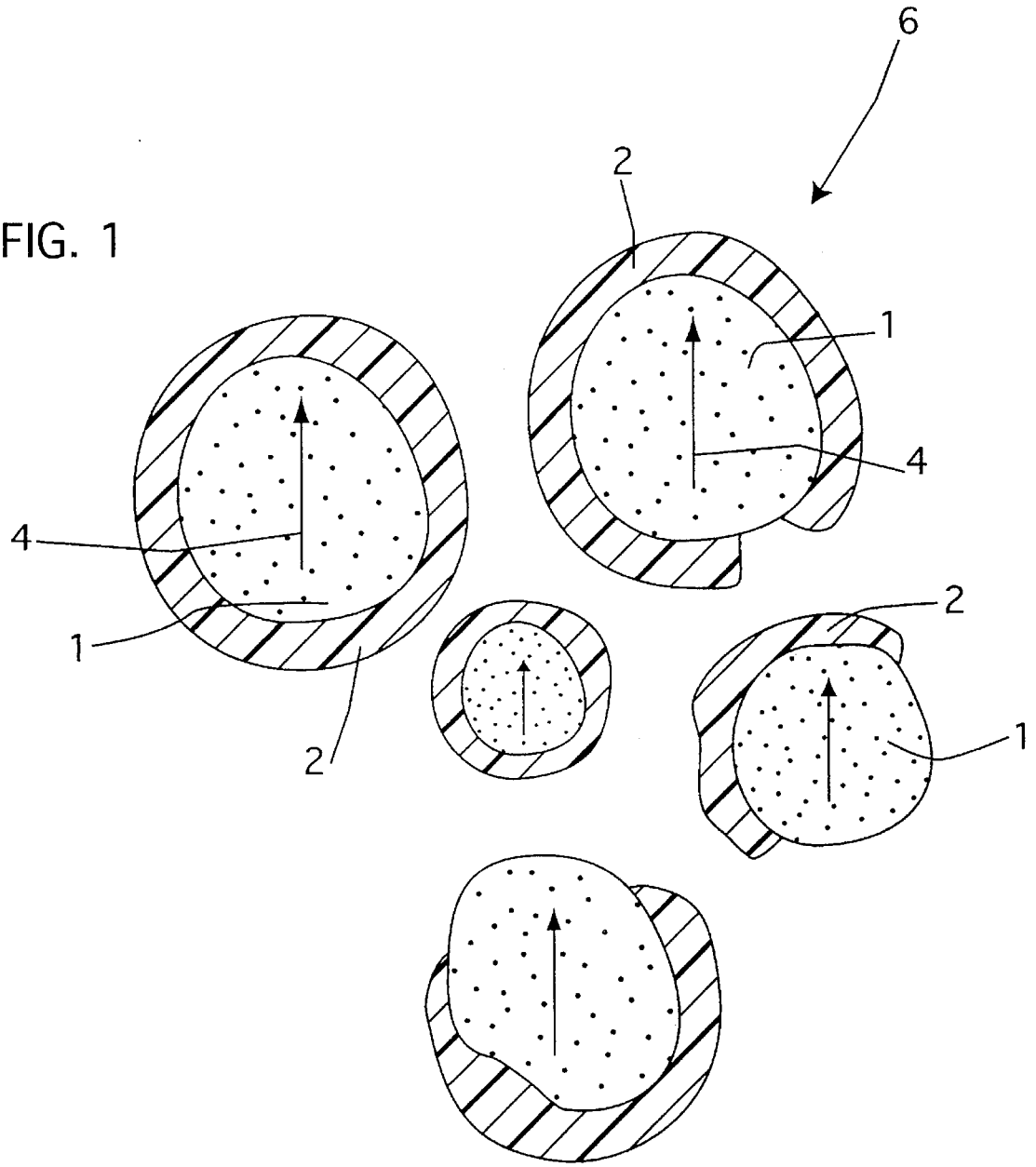
FIG. 1 is a cross section illustrating the solid resin-coated magnet powder according to an embodiment of the present invention.
Figure 2:
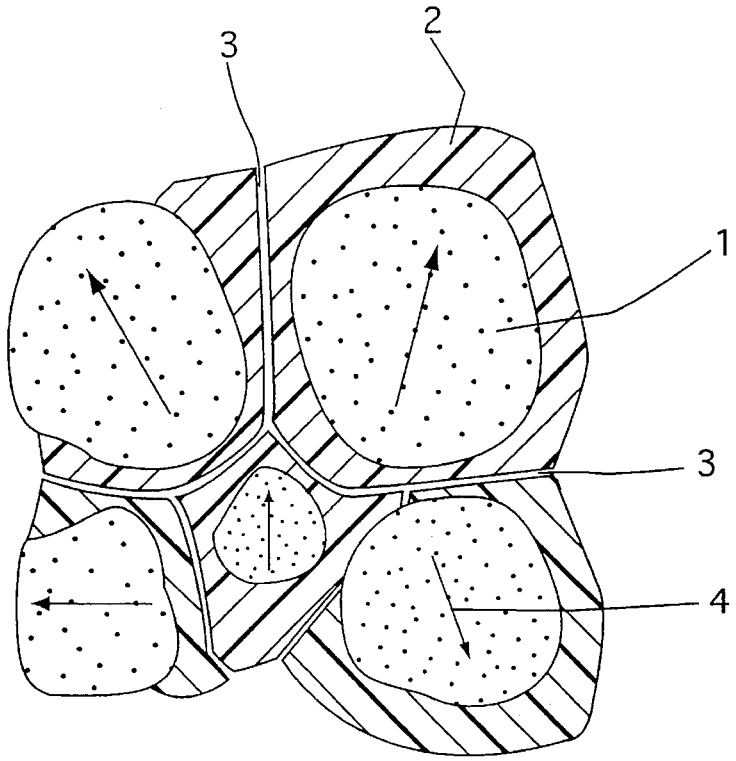
FIG. 2 is a cross section illustrating a method of producing a solid resin-coated magnet powder of the present invention by cracking a conventional solid resin-coated composite magnet powder.
Figure 3:
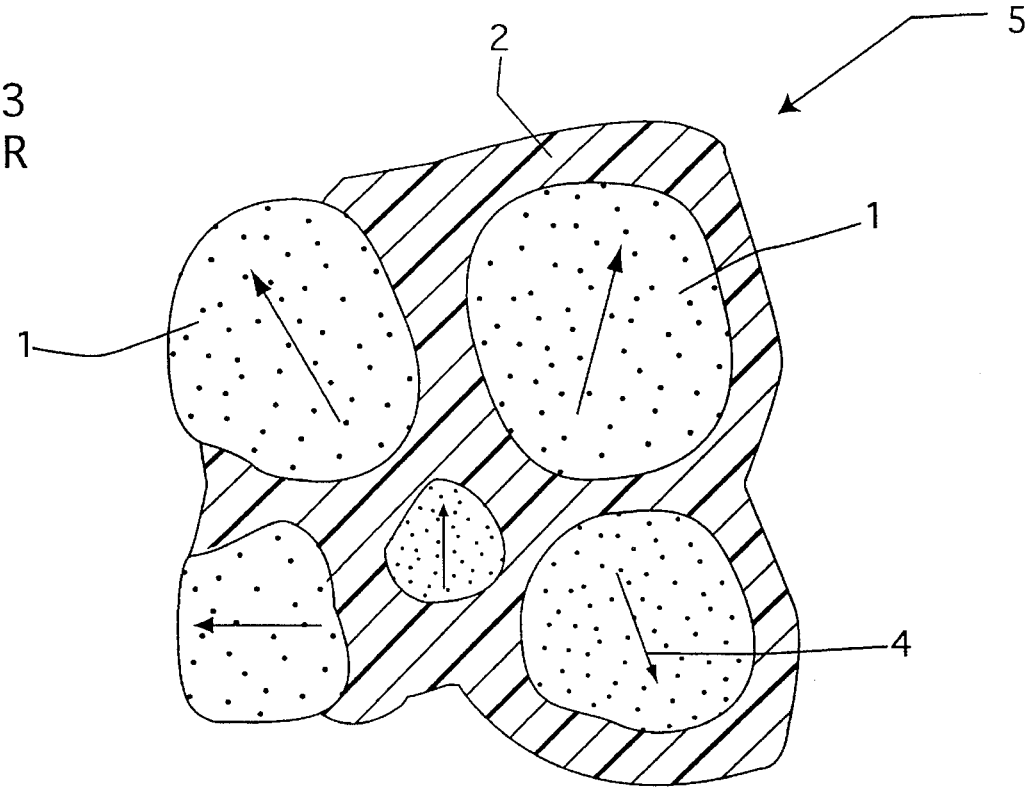
FIG. 3 is a cross section illustrating a solid resin-coated composite magnet powder according to the prior art.

Referring to FIGS. 1, 2 and 3, the solid resin 2 of a conventional solid resin-coated composite powder 5 of FIG. 3 is cracked to produce cracks 3 therein, as shown in FIG. 2. Composite powder 5 is separated along cracks 3 into individual anisotropic magnet powder particles 6 coated with solid resin 2.

As illustrated in FIG. 1, when solid resin-coated magnet powder 6 is molded in a magnetic field, the orientation directions 4 of the individual solid resin-coated magnet powder particles 6 are rotated into alignment with the magnetic field because the respective solid resin-coated magnet powder particles 6 are separated from each other. An anisotropic bonded magnet produced using the solid resin-coated magnet powder particles 6 thus exhibits improved magnetic anisotropy.

The solid resin-coated magnet powder particles 6 shown in FIG. 1 have a high degree of mechanical freedom, thus permitting them to be mechanically packed closely together during molding. As a result, the density of the resulting molded product; produced using the same molding pressure, is also increased. The combination of the improved alignment of orientation directions 4, together with the increased density from improved packing, further improves the magnetic characteristics of an anisotropic magnet formed from magnet powder particles 6.

Any suitable resin which is solid at room temperature such as, for example, epoxy, polyester or phenolic resin, in the preferred embodiment, a bismaleimidotriazine resin (referred to as "BT resin" hereinafter) is used for solid resin 2.

BT resin has characteristics which permit the solid resin-coated powder 6 shown in FIG. 1 to be easily produced by cracking, and prevents damage to the anisotropic magnet powder during cracking and deterioration of the magnetic characteristics, particularly its coercive force.

An anisotropic magnet powder used for producing the solid resin-coated magnet powder for producing an improved anisotropic bonded magnet is formed by maintaining an alloy consisting of, as main components, rare earth elements including Y (referred to as "R" hereinafter), Fe or a component obtained by partially substituting Fe with Co (referred to as "T" hereinafter) and B, and 0.01 to 5.0 atomic % M (M is at least one of Ga, Hf, Nb, Ta, W, Mo, Al, Ti, Si and V) to homogenized the alloy at a temperature of 600° to 1200° C. The homogenized alloy comprising R, T and B as main components is thereafter hydrogen treated by the method below. The alloy is then cooled to obtain an alloy having a recrystallized fine aggregate structure with a ferromagnetic phase. The cooled alloy is finely ground to produce magnet powder particles 6.

In the hydrogen treatment, the homogenized alloy consisting of R, T and B as main components, is heated from room temperature to 500° C. in a hydrogen atmosphere, and is then maintained at a temperature of 500° C. The alloy is caused to further occlude hydrogen by further heating to a predetermined temperature between about 750° and about 950° C. and maintaining it at this temperature to promote the phase transformation thereof. Then the alloy is forced to release hydrogen by maintaining it at a temperature of from about 750° to about 950° C. in a vacuum atmosphere to promote the phase transformation thereof. Each of the thus-formed magnet powder particles consisting of R, T and B as main components has magnetic anisotropy. The magnet powder is kneaded with a solid resin diluted with an organic solvent such as acetone or the like at a pressure of 100 Torr or less. The resultant mixture is then granulated to produce the solid resin-coated composite powder 5 coated with the solid resin 2 and containing a plurality of anisotropic magnet powder particles 1, as shown in FIG. 3.

An R-Fe-B anisotropic magnet powder obtained by grinding a full-dense magnet which is made anisotropic by plastic working as well as anisotropic magnet powder of $SmCo_5$, $Sm_2Fe_{17}$ or Sm-Fe-N can be used as a magnet powder in place of the magnet powder consisting of R, T and B as main components.

When the solid resin-coated composite magnet powder 5 is ground with ceramic balls of aluminum, glass, or the like, or plastic balls with a density of 5 g/cm$^3$ or less in a grinder such as a ball mill or an attritor mill, cracks 3 are produced in the magnet powder 5, as shown in FIG. 2, to separate magnet powder 5 into the individual anisotropic magnet powder particles 6 shown in FIG. 1. The ceramic balls, plastic balls or bails of like density must be used in this operation, since the use of balls of a hard metal or stainless steel with a density in excess of 5 g/cm$^3$ undesirably causes grinding of the magnet powder particles due to the high specific gravity thereof. The thus-obtained solid resin-coated magnet powder particles 6 of the present invention comprise individual anisotropic magnet powder particles 1, each coated with the solid resin 2. Each magnet powder particle 6 exhibits magnetic anisotropy.

When the solid resin-coated magnet powder 6 is introduced into a mold and press-molded in a magnetic field, a bonded magnet exhibiting a high degree of anisotropy can be produced because all the magnet powder particles 1 of the magnet composite powder 6 are separate and are thus capable of being oriented in a direction aligned with the magnetic field applied. In order to produce an anisotropic bonded magnet having the desired improved characteristics, a raw material powder preferably contains at least 30%, and more preferably 50% of the solid resin-coated magnet powder 6 as shown in FIG. 1. The remainder of the raw material powder may be composite powder 5. In addition, since solid resin is used in the resin-coated magnet powder of the present invention, the magnet powder has good fluidity, and the density of the molded product is increased to the same level as that of a product formed using a liquid resin.

The present invention is described in detail below with reference to examples.

EXAMPLE 1

An ingot formed in a high-frequency furnace by melting and casting in an atmosphere of Ar gas an alloy consisting of 28.0% by weight Nd, 15.0% by weight Co, 1.0% by weight B, 0.1% by weight Zr, 0.5% by weight Ga, and the balance comprising Fe and inevitable impurities. The alloy was homogenized by maintaining it at a temperature of 1150° C. Hydrogen treatment was then performed by the method below. The homogenized ingot was caused to occlude hydrogen by heating from room temperature to about 500° C. in an atmosphere of hydrogen and maintaining it at 500° C. The ingot was then caused to further occlude hydrogen by heating to a temperature of 850° C. and maintaining it at this temperature to promote phase transformation thereof. The hydrogen occluded by the ingot was then forced from the ingot by maintaining the ingot at a temperature of 850° C. in a vacuum to promote the phase transformation thereof. After cooling, the ingot was ground in a flow of Ar gas to produce an Nd-Fe-B anisotropic magnet powder having an average particle size of 80 μm.

A BT resin solution was produced by dissolving 10 g of solid BT resin in 100 g of acetone. The BT resin solution was added to the Nd-Fe-B magnet powder at a ratio of resin component of 3% by weight, and was then kneaded at a reduced pressure of 1 Torr or less to form a solid BT resin layer on the surfaces of the Nd-Fe-B magnet powder particles. This treatment continued until the acetone was completely volatilized. The magnet powder was then granulated to form a solid BT resin-coated magnet powder.

The resultant product comprised a bulk solid BT resin-coated composite magnet powder containing a plurality of Nd-Fe-B magnet powder particles, having a structure as shown in FIG. 3. The solid BT resin-coated composite magnet powder was then placed in the pot of a ball mill together with alumina balls, and was cracked by rotating the ball mill for 20 minutes. Scanning electron microscope (SEM) observation of the thus-obtained solid resin-coated magnet powder of the present invention revealed that at least 90% of the magnet powder consisted of individual resin-coated magnet powder containing anisotropic magnet powder particles 6 each of which exhibited magnetic anisotropy.

The solid resin-coated magnet powder particles 6 of the present invention was introduced into a mold without any further treatment, and were press-molded under a pressure of 6 ton/cm$^2$ in a magnetic field of 20 KOe to produce a molded product having a length of 10 mm, a width of 10 mm and a height of 10 mm. The molded product obtained was then hardened by maintaining it at a temperature of 150° C. for 2 hours to produce an anisotropic bonded magnet.

CONVENTIONAL EXAMPLE 1

For comparison, the solid BT resin-coated composite magnet powder produced in Example 1 was introduced into a mold without being cracked in a ball mill, and was processed under the same conditions as those in Example 1 to produce a conventional anisotropic bonded magnet 1.

The density, residual flux density Br, coercive force iHc, and maximum energy product (BH)max of the anisotropic bonded magnet 1 of this invention and the conventional anisotropic bonded magnet 1 were measured. The results of measurement are shown in Table 1.

TABLE 1

| Kind | Density (g/cm3) | Magnetic Characteristics Br (KG) | iHc (KOe) | (BH)max (MGOe) |
|---|---|---|---|---|
| Anisotropic bonded magnet 1 of this invention | 6.21 | 9.3 | 13.6 | 19.4 |
| Conventional anisotropic bonded magnet 1 | 6.03 | 8.6 | 13.7 | 16.1 |

EXAMPLE 2

A full-dense magnet which was made anisotropic by plastic working was ground to prepare an Nd-Fe-B plastically worked anisotropic magnet powder. The Nd-Fe-B magnet powder was used for producing a solid BT resin-coated composite magnet powder by the method described in Example 1. The composite magnet powder produced was cracked by the same method as that in Example 1 to produce a solid resin-coated magnet powder of this invention. SEM observation revealed that the obtained solid resin-coated magnet powder of this invention contained at least 80% solid resin-coated magnet powder containing anisotropic magnet powder particles exhibiting magnetic anisotropy. An anisotropic bonded magnet was produced using the solid resin-coated magnet powder under the same conditions as those in Example 1.

CONVENTIONAL EXAMPLE 2

For comparison, the solid BT resin-coated composite magnet powder produced in Example 2 was introduced into a mold without cracking, and was then processed by the same method as that in Example 2 to produce a conventional anisotropic bonded magnet 2.

The density, residual flux density Br, coercive force iHc, and maximum energy product (BH)max of the anisotropic bonded magnet 2 of this invention and the conventional anisotropic bonded magnet 2 were measured. The results of measurement are shown in Table 2.

TABLE 2

| Kind | Density (g/cm3) | Magnetic Characteristics Br (KG) | iHc (KOe) | (BH)max (MGOe) |
|---|---|---|---|---|
| Anisotropic bonded magnet 2 of this invention | 6.16 | 8.6 | 13.5 | 16.4 |
| Conventional anisotropic bonded magnet 2 | 6.02 | 7.4 | 13.5 | 12.2 |

EXAMPLE 3

An $Sm_2Co_{17}$ anisotropic magnet powder was used for producing a solid resin-coated composite magnet powder, using the techniques in Example 1. The composite magnet powder produced was cracked by the same method as that described in Example 1 to produce a solid resin-coated magnet powder of this invention. SEM observation of the obtained solid resin-coated magnet powder contained at lease 90% solid resin coated anisotropic magnet powder particles each exhibiting magnetic anisotropy. An anisotropic bonded magnet was produced using the solid resin-coated magnet powder under the same conditions as those in Example 1.

CONVENTIONAL EXAMPLE 3

For comparison, the solid BT resin-coated composite magnet powder produced in Example 3 was introduced into a mold without cracking, and was then processed by the same method as that in Example 3 to produce a conventional anisotropic bonded magnet 3.

The density, residual flux density Br, coercive force iHc, and maximum energy product (BH)max of the anisotropic bonded magnet 3 of this invention and the conventional anisotropic bonded magnet 3 were measured. The results of measurement are shown in Table 3.

TABLE 3

| Kind | Density (g/cm3) | Magnetic Characteristics Br (KG) | iHc (KOe) | (BH)max (MGOe) |
|---|---|---|---|---|
| Anisotropic bonded magnet 3 of this invention | 7.11 | 8.1 | 11.5 | 15.0 |
| Conventional anisotropic bonded magnet 3 | 7.00 | 7.3 | 11.7 | 11.8 |

EXAMPLE 4

An Sm-Fe-N anisotropic magnet powder was used for producing a solid BT resin-coated composite magnet powder. The composite magnet powder produced was cracked by the same method as that in Example 1 to produce a solid resin-coated magnet powder of this invention. SEM observation of the obtained solid resin-coated magnet powder of this invention revealed that at least 50% of the solid resin-coated magnet powder consisted of solid resin coated anisotropic magnet powder particles each exhibiting magnetic anisotropy. An anisotropic bonded magnet was formed using the resulting magnet powder under the same conditions as those in Example 1.

CONVENTIONAL EXAMPLE 4

For comparison, the solid BT resin-coated composite magnet powder produced in Example 4 was filled in a mold without cracking, and was then processed by the same method as that in Example 4 to produce a conventional anisotropic bonded magnet 4.

The density, residual flux density Br, coercive force iHc, and maximum energy product (BH)max of the anisotropic bonded magnet 4 of this invention and the conventional anisotropic bonded magnet 4 were measured. The results of measurement are shown in Table 4.

TABLE 4

| Kind | Density (g/cm3) | Magnetic Characteristics Br (KG) | iHc (KOe) | (BH)max (MGOe) |
|---|---|---|---|---|
| Anisotropic bonded magnet 4 of this invention | 5.72 | 8.0 | 7.5 | 12.1 |
| Conventional anisotropic bonded magnet 4 | 5.57 | 7.2 | 7.7 | 9.8 |

The results shown in Tables 1 to 4 reveal that the anisotropic bonded magnet produced using the solid resin-coated magnet powder of the present invention exhibits maximum energy product (BH)max and magnetic characteristics which are better than those of the conventional anisotropic bonded magnet produced using conventional solid resin-coated composite magnet powder.

EXAMPLES 5 and 6

A solid resin-coated magnet powder was produced using the Nd-Fe-B magnet powder produced in Example 1 and each of solid epoxy and solid polyester resins as a resin. Anisotropic bonded magnets were respectively produced using the solid resin-coated magnet powders produced by the same method as that in Example 1, and were compared with the anisotropic bonded magnet of this invention produced using the solid BT resin in Example 1. The comparative results are shown in Table 5.

TABLE 5

| Kind (Coating resin is parenthesized) | Density (g/cm3) | Magnetic Characteristics Br (KG) | iHc (KOe) | (BH)max (MGOe) |
|---|---|---|---|---|
| Anisotropic bonded magnet of this invention (BT resin) | 6.21 | 9.3 | 13.6 | 19.4 |
| Anisotropic bonded magnet of this invention (epoxy resin) | 6.18 | 9.2 | 11.5 | 18.0 |
| Anisotropic magnet of this invention (polyester resin) | 6.19 | 9.2 | 11.7 | 17.5 |

The results shown in Table 5 reveal that magnetic characteristics of the anisotropic bonded magnet produced using the solid BT resin are better than those of the anisotropic bonded magnet produced using solid epoxy resin or solid polyester resin. It is thus found that solid BT resin is more desirable than the solid epoxy resin and the solid polyester resin.

As described above, the solid resin-coated magnet powder of the present invention can provide a bonded magnet exhibiting improved magnetic anisotropy, as compared to a conventional bonded magnet, having excellent industrial application.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A method for making a solid resin-coated magnet powder comprising:

forming an alloy ingot;

heating said alloy ingot in a hydrogen atmosphere;

continuing said heating to promote phase transformation of said alloy ingot;

maintaining said alloy ingot in a vacuum at an elevated temperature to further promote phase transformation;

grinding said ingot to produce an anisotropic powder;

dissolving a plastic resin in a solvent to produce a solution;

mixing said anisotropic powder with said solution;

kneading said anisotropic powder in said solution in a vacuum until said solvent is substantially completely volatilized;

granulating the product of said kneading step to produce a composite powder; and ball milling said composite powder to produce a resulting product containing a substantial fraction consisting of individual magnet powder particles coated with said plastic resin.

2. A process according to claim 1, wherein said substantial fraction includes at least 30% by weight.

3. A process according to claim 1, wherein the step of ball milling includes ball milling using balls having a density of no more than 5 $g/cm^3$.

4. A process according to claim 1, wherein said substantial fraction includes at least 50% by weight.

* * * * *